United States Patent [19]

Shefsiek

[11] 4,330,031

[45] May 18, 1982

[54] CERAMIC TUBE RECUPERATOR

[75] Inventor: Paul K. Shefsiek, Farmington Hills, Mich.

[73] Assignee: Holcroft & Company, Livonia, Mich.

[21] Appl. No.: 74,899

[22] Filed: Sep. 12, 1979

[51] Int. Cl.[3] ..... F28F 9/06; F28F 21/04; F28D 7/12

[52] U.S. Cl. ..... 165/76; 165/142; 165/178; 285/9 R; 432/179

[58] Field of Search ..... 165/142, 178, DIG. 8, 165/76, 78, 69, 82, 83, 173, 175; 285/9 R; 432/179

[56] References Cited

U.S. PATENT DOCUMENTS

| | | | |
|---|---|---|---|
| 1,758,582 | 5/1930 | Mott | 165/142 |
| 3,185,210 | 5/1965 | Kuhne et al. | 165/173 |
| 3,263,747 | 8/1966 | McKay | 165/178 |
| 3,610,595 | 10/1971 | Laws et al. | 165/176 |
| 4,106,556 | 8/1978 | Heyn et al. | 165/142 |
| 4,120,352 | 10/1978 | Husson | 165/82 |
| 4,122,894 | 10/1978 | Laws et al. | 165/175 |

FOREIGN PATENT DOCUMENTS

| | | | |
|---|---|---|---|
| 763540 | 5/1934 | France | 165/142 |

*Primary Examiner*—Sheldon J. Richter
*Attorney, Agent, or Firm*—Whittemore, Hulbert & Belknap

[57] ABSTRACT

A ceramic tube recuperator for recovering energy from hot flue gases, in which a multiplicity of heat exchange elements connected to a cold air inlet manifold and a hot air outlet chamber extend upwardly into a flow passage for hot flue gases. Each heat exchanger comprises an inner open ended tube extending into the cold air inlet manifold, and an outer ceramic tube having a closed upper end and an open lower end communicating with the hot air chamber. An essential feature of the invention is that the lower end of the ceramic tube is sealed solely as a result of resting on an annular seal, so that the ceramic tube may be removed and replaced simply by lifting and lowering through an access opening in the flue passage.

14 Claims, 5 Drawing Figures

FIG. 2
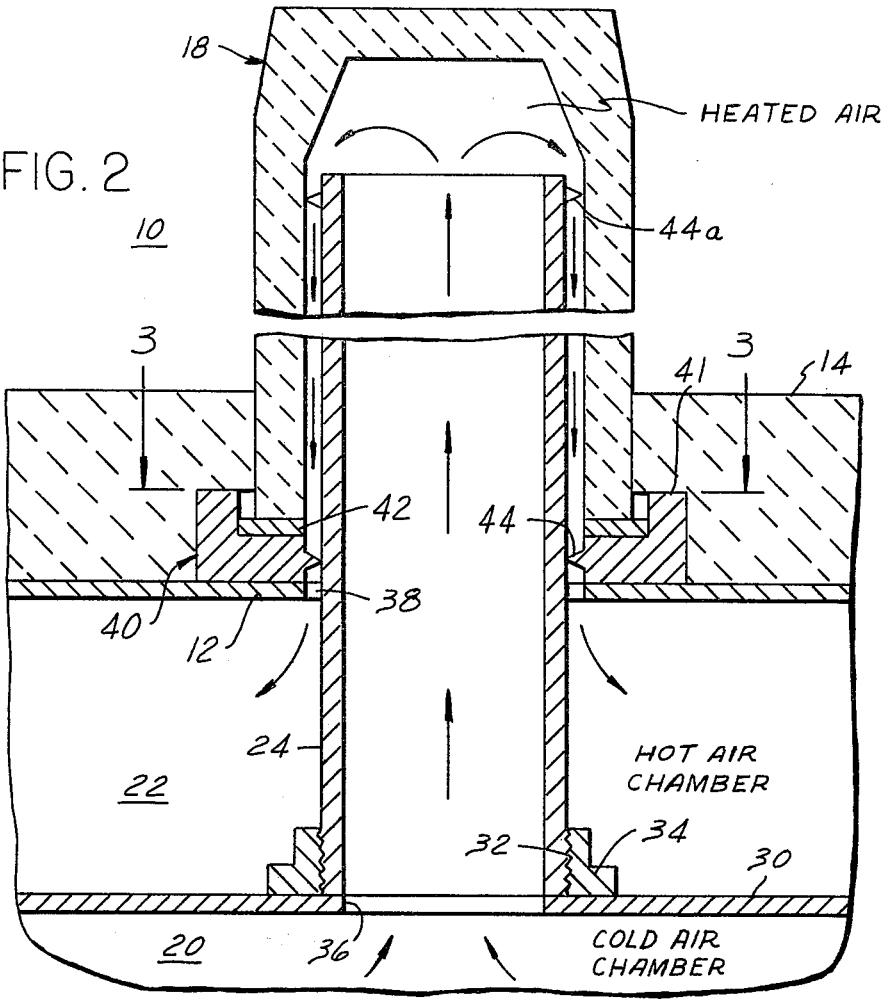
FIG. 3
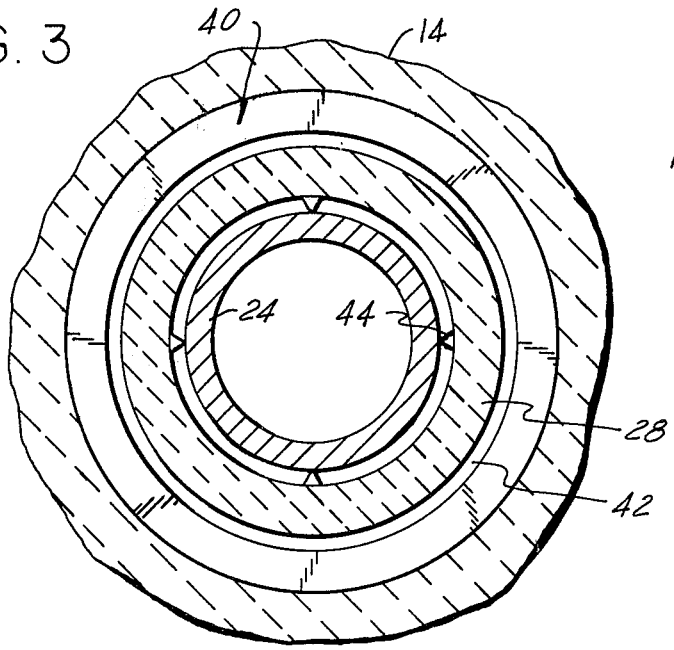
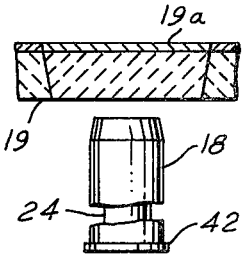
FIG. 4
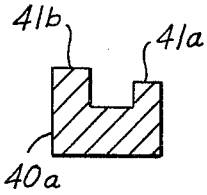
FIG. 5

CERAMIC TUBE RECUPERATOR

BACKGROUND AND SUMMARY OF THE INVENTION

Recuperators are commonly used to recover energy from flue gas. It has been known to provide inner and outer tubes in which the flow of cold air is through the inner tube into the inner closed end of the outer tube and thence outwardly in a passage of annular configuration to a hot air chamber or vice versa. The inner tube passes through the hot air chamber and the outer tube extends substantially across the flue gas passage so that the entering cold air is somewhat heated in the hot air passage and is substantially heated as it passes between the outer wall of the inner tube and the inner wall of the outer tube substantially across the hot flue gas passage.

In accordance with the present invention the inner tube, which is not subjected to temperatures approaching the flue gas temperatures, is made of steel, preferably a suitable stainless steel. The outer tube which of course is exposed directly to the extremely hot flue gases is made of a ceramic material.

The spacing between the outer wall of the inner tube and the inner wall of the outer tube is relatively small so that the cool air is efficiently heated as it traverses the inner surface of the hot outer ceramic tube.

In accordance with the present invention the outer ceramic tube has an annular support surface at one end and the necessary sealing of this tube with respect to the apertured surface which supports it, is provided simply by causing the weight of the ceramic tube to apply pressure to this annular support surface which is supported on a suitable heat-resistant fiber sealing pad.

Preferably the combination of the inner tube and outer tube extends upwardly from the lower surface of the flue gas passage, in which case the outer ceramic tube has an upper closed end and its lower open end provides the sealing action through the weight of the ceramic tube resting on the annular sealing pad. This permits the outer ceramic tube to be removed simply by lifting through an access opening provided at the top of the flue gas passage.

It has been found that the inner metallic tube does not attain excessive temperatures, even under conditions of partial failure of the system, and accordingly it has been found practical to provide the inner open ended metal tubes with a simple threaded connection at the lower ends thereof to a threaded fitting provided at an opening in the wall dividing the cold air manifold and the superimposed hot air chamber. Thus both the inner and outer tubes can be readily removed and replaced through an access opening provided in the upper wall of the flue passage.

BRIEF DESCRIPTION OF THE DRAWINGS

FIG. 2 is an enlarged vertical section through a heat exchanger element.

FIG. 3 is a sectional view on the line 3—3, FIG. 2.

FIG. 4 is a fragmentary side view showing the removable closure above the heat exchange tube.

FIG. 5 is a cross-sectional view through a modified tube supporting fitting.

DETAILED DESCRIPTION

Figure 1:
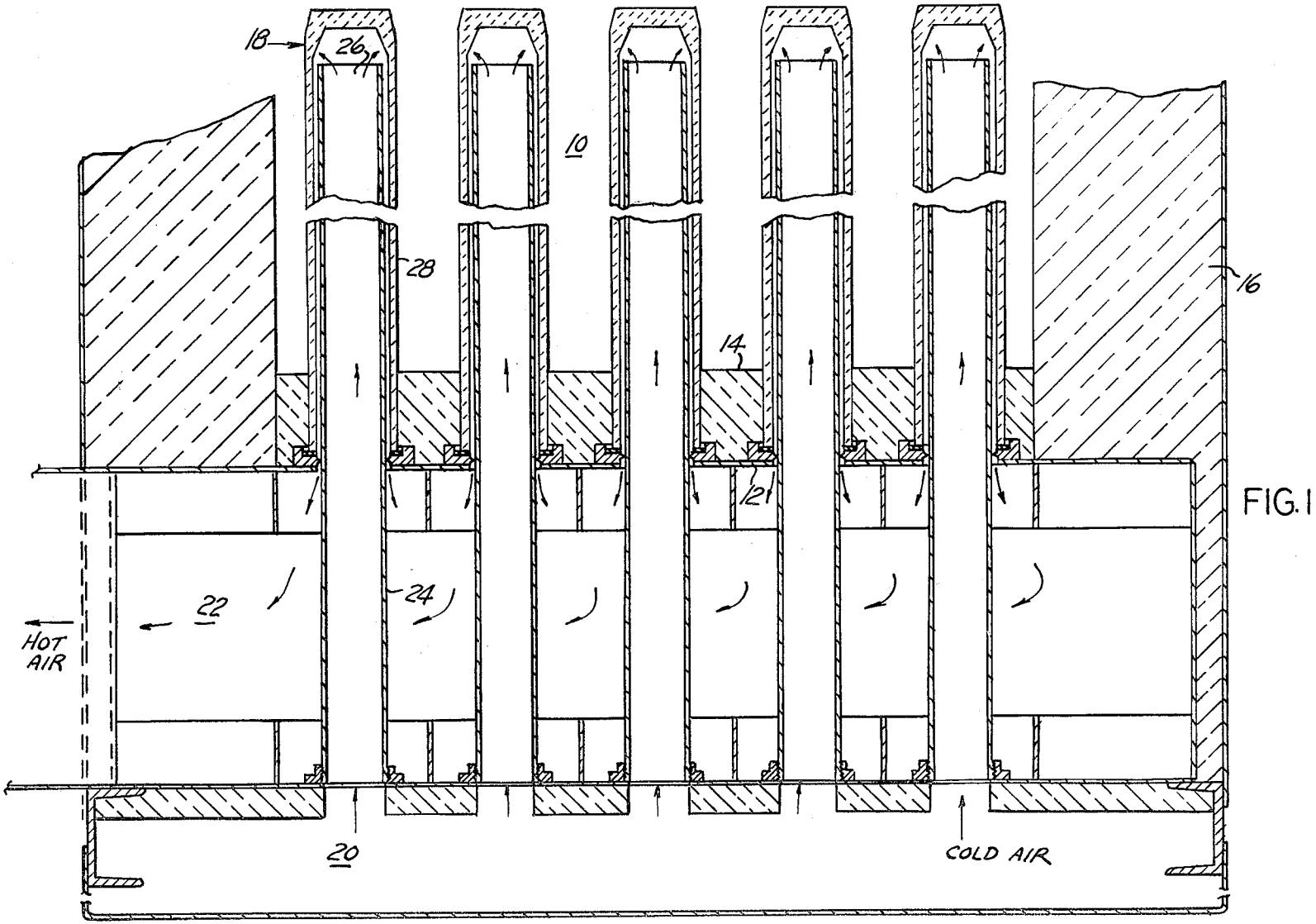
FIG. 1 is a vertical section through a recuperator construction in accordance with the present invention.

As illustrated in FIG. 1 a flue gas passage is indicated at 10 through a flue duct comprising a bottom wall 12 provided with suitable insulating material as indicated at 14, insulating side walls 16 and an upper wall 19 which extends adjacent to the upper end of a multiplicity of heat exchange units indicated generally at 18. It will be understood that the upper wall of the flue is provided with suitable openings affording access to the upper ends of the heat exchange units 18. These access openings are of course provided with removable heat insulating closures 19*a*.

The purpose of the recuperators is to heat incoming cold air adapted to be supplied to the combustion chambers of a furnace. This air is substantially heated by the heat exchangers 18 as it passes from a cold air chamber or manifold 20 through the heat exchangers 18 to the hot air chamber 22.

As well illustrated in FIG. 1 the air passes upwardly through an inner metal tube 24 which is open at its upper end as indicated at 26, and thence passes downwardly through the narrow annular space provided between an upper portion of the metal tube 24 and an outer ceramic tube 28. Details of this construction are best seen in FIGS. 2 and 3 to which reference is now made. As seen in these figures a partition or common wall 30 is provided between the lower cold air chamber or manifold 20 and the superimposed hot air chamber 22. The metal tube 24 which is preferably threaded at its lower end as indicated at 32 is threadingly engaged with a fitting 34 welded or otherwise secured to the partition 30 surrounding an opening 36 therein.

The metal tube 24 extends upwardly through an opening 38 provided in the common wall 12 separating the hot air chamber 22 from the flue gas passage 10.

Above the opening 38 in the wall 12 is an annular fitting 40 of L-shaped cross-section having an outer upwardly extending flange 41 within which is received a flat annular sealing pad 42. Fitting 40 as best seen in FIG. 3 is provided with a few spacing fingers 44 engageable with the outer surface of the metal tube 24. The upper end of the inner tube is provided with similar projections indicated at 44*a* to ensure uniformity of spacing between the inner and outer tubes.

Alternatively, as seen in FIG. 5, the fitting here designated 40*a* 40 may be of U-shaped cross-section having inner and outer upwardly extending flanges 41*a* and 41*b* between which the sealing pad and lower edge of the ceramic tube 28 are received. In this case, the adjacent portion of the metal tube will be necked down to provide clearance for flow of hot air, while maintaining the desired clearance between the metal and ceramic tubes.

Excellent results have been obtained when the ceramic tube 28 is formed of silicon carbide although other heat resistant ceramic materials, such for example as magnesia-alumina-silicate mixture, may be used. Excellent results have been obtained when the inner metal tube is a type HK stainless steel containing approximately 26% chromium, 20% nickel, and the balance iron, although other heat resistant metallic materials like type HT, Inconel, etc. may be used.

The sealing pad 42 is formed of inorganic fibrous material capable of withstanding the extremely high temperatures attained by the outer ceramic tube. A material which has proven to be completely satisfactory for this purpose is formed of alumina fibers available under the trademark "Saffil" registered by the Imperial Chemical Industries of the U.K., and distributed in this country by Babcock & Wilcox. As an alternative material, combinations of silica and alumina fibers are satisfactory.

A test unit of the present invention which has been fully tested employs outer ceramic tubes having an outside diameter of 5.63 inches, an inside diameter of 4.50 inches and accordingly a wall thickness of approximately 0.565 inches. The inner metal tube has an outside diameter of 3.75 inches and an inside diameter of approximately 3.44 inches and accordingly a wall thickness of approximately 0.155 inches. Further, from these dimensions it will be observed that the annular space between the outside wall of the inner tube and the inside wall of the outer tube has a radial dimension of 0.375 inches. Thus the cross-sectional area of the upward flow through the metal tube is much greater than the cross-sectional area of the downward flow between the inner metal tube and the outer ceramic tube. This relative small dimension of space between the tubes ensures good velocity and heat transfer between the hot surface of the ceramic tube and the air flowing downward through this annular space.

For example, it has been found that with flue gas entering the recuperator at a temperature of 2500° F., the combustion air may be preheated to a temperature of 1380° F. The air flow through a single tube assembly is 3880 SCFH.

Since the support and sealing of the ceramic tube is the result of simply placing the tube on the annular seal, it is important that the tube have a sufficient diameter to provide stability, and sufficient weight to provide an efficient seal. Accordingly the tube should have an outside diameter 4–7 inches, preferably about five and one-half (5½) inches; a wall thickness of 0.4–0.7 inches, preferably about one-half (½) inch; and a weight of about seventy-five (75) pounds.

The length of the ceramic tubes is approximately eighty (80) inches and the weight is approximately seventy-five (75) pounds. Accordingly with the unit construction as illustrated it will be appreciated that the pressure applied by the bottom annular space of the ceramic tube, which has an area of approximately nine square inches to the fiber seal 42, is about eight and one-third pounds per square inch. This is effective to provide a perfectly satisfactory seal while at the same time permitting the ceramic tube to be applied by merely placing it on the annular seal, and removed by merely lifting it from the seal.

When the ceramic tube extends upwardly as illustrated herein, it will be seen that the flat annular seating and sealing surface at its lower end is co-extensive with the cross-section of the tubular wall of the tube.

It will further be apparent that with the ceramic tube removed, access is afforded to the inner metal tube through the access opening provided in the top surface of the flue gas passage, and the metal tube may be removed simply by unscrewing it from the fitting 34.

While the preferred embodiment of the invention as illustrated is one in which the outer ceramic tube extends upwardly into the flue gas passage, certain features of the invention may be employed in an arrangement in which the ceramic tube is suspended by a flange provided at its upper open end, with its closed end extending downwardly through the flue gas passage.

I claim:

1. A recuperator for recovering energy from hot flue gases which comprises a horizontal flue gas passage, a horizontally extending cold air chamber below said passage, and a horizontally extending hot air chamber interposed between said passage and said cold air chamber, said hot air chamber having a first horizontal common wall with said flue gas passage and a second horizontal common wall with said cold air chamber, said common walls having a multiplicity of pairs of vertically aligned openings, a corresponding multiplicity of vertical heat exchange units, each of which is associated with one of said pairs of openings, said units comprising vertical open ended tubes having their lower open ends supported on said second common wall in registration with one of said openings therein and extending through the vertically aligned openings in said first common wall with clearance to provide for air flow through the openings in said first common wall exterior of said open ended tubes, annular sealing and support pads on said first common wall surrounding the openings therein having exposed upper horizontal surfaces, outer vertically extending ceramic heat transfer tubes formed of a material capable of withstanding the extremely high temperatures of flue gases, said ceramic tubes having closed upper ends adjacent the top wall of said passage, said ceramic tubes having at their bottom open ends horizontal annular support and sealing surfaces conformed to rest upon said pads, said ceramic tubes surrounding the portions of said open ended tubes within said passage, the closed upper ends of said ceramic tubes being slightly spaced from the upper ends of said open ended tubes and defining therewith annular spaces for the flow of air from the tops of said open ended tubes downwardly to said hot air chamber, said pads constituting the sole support for said ceramic tubes whereby said ceramic tubes may be readily installed or removed by simple placement or lifting of the ceramic tubes onto or off of said pads through access openings provided in the top wall of said passage.

2. A recuperator as defined in claim 1, which comprises removable closures for said access openings.

3. A recuperator as defined in claim 1, in which said sealing pad is fibrous.

4. A recuperator as defined in claim 1, comprising an annular fitting surrounding each opening in said first common wall, said fittings having outer upwardly directed annular flanges and inwardly extending flat radial flanges, said sealing pads being received within said upwardly directed annular flanges, and supported on said inwardly extending flat radial flanges.

5. A recuperator as defined in claim 4, in which said fittings have inner upwardly directed annular flanges spaced inwardly from said outer upwardly directed annular flanges, said sealing pads being positioned between said inner and outer flanges.

6. A recuperator as defined in claim 4, said fitting having radially inwardly projecting centering fingers engageable with the inner metal tube.

7. A recuperator as defined in claim 6, the upper end of said metal tube having radially outwardly directed centering fingers engageable with the inner surface of the ceramic tube.

8. A recuperator as defined in claim 1, in which said ceramic tube is formed of silicon carbide.

9. A recuperator as defined in claim 1, in which said ceramic tube has a wall thickness of about one-half inch, an outside diameter of about 4–7", and a weight of about seventy-five (75) pounds.

10. A recuperator as defined in claim 1 in which the cross-sectional area of the end of tube supported on said pad is related to the weight of said ceramic tube such that the pressure of the tube on said pad is about eight psi.

11. A recuperator as defined in claim 1, in which the lower end of the metal tube has a threaded connection with the said second common wall.

12. A recuperator as defined in claim 11, in which the top of said flue gas passage has an access opening provided with a removable closure which provides for placement and removal of both the ceramic and metal tubes therethrough.

13. A recuperator as defined in claim 1, in which said fibrous sealing pad comprises alumina or silica fibers, or combinations thereof.

14. A recuperator comprising a horizontal flue gas passage having top and bottom walls, heat exchange units each comprising a vertical ceramic tube extending substantially across the passage, an access opening in said top wall above said tube and dimensioned to provide for insertion of said ceramic tubes therethrough, a removable closure for said access opening, said tube having a closed upper end within the passage adjacent the top wall thereof and an open bottom end in communication with a smaller opening in the bottom wall of said passage, means sealing said ceramic tube around the smaller opening comprising a flat annular heat resistant fiber sealing pad surrounding the smaller opening, said tube having a substantially flat annular sealing surface at its bottom open end resting on said pad and supporting the weight of said tube, and constituting the sole connection between said tube and said flue gas passage whereby said tube may be positioned and sealed by simple placement on the sealing pad.

* * * * *